United States Patent [19]

MacLeod et al.

[11] Patent Number: 4,924,761

[45] Date of Patent: May 15, 1990

[54] ROOF VENT

[75] Inventors: Richard J. MacLeod, Milford; Charles E. Schiedegger, Metamora; Norman L. Chubb, Dearborn, all of Mich.

[73] Assignee: Tapco Products Company, Inc., Detroit, Mich.

[21] Appl. No.: 293,946

[22] Filed: Jan. 5, 1989

[51] Int. Cl.[5] ..... F24F 7/02

[52] U.S. Cl. ..... 98/42.21; 52/199; 98/42.22; 98/121.1

[58] Field of Search ..... 52/199; 98/42.01, 42.21, 98/42.22, 121.1

[56] References Cited

U.S. PATENT DOCUMENTS

| | | | |
|---|---|---|---|
| 1,785,682 | 12/1930 | Hamilton | 98/121.1 X |
| 1,896,656 | 2/1933 | Anderson | 98/121.1 X |
| 3,236,170 | 2/1966 | Meyer et al. | 98/42.21 |
| 3,660,955 | 5/1972 | Simon | 98/42.21 X |
| 4,280,399 | 7/1981 | Cunning | 98/42.21 |
| 4,325,290 | 4/1982 | Wolfert | 98/42.21 |
| 4,545,291 | 10/1985 | Kutsch et al. | 98/42.21 |
| 4,642,958 | 2/1987 | Pewitt | 98/42.21 X |
| 4,643,080 | 2/1987 | Trostle et al. | 98/42.21 |
| 4,817,506 | 4/1984 | Cashman | 98/42.21 |

FOREIGN PATENT DOCUMENTS

| | | | |
|---|---|---|---|
| 3320850 | 12/1984 | Fed. Rep. of Germany | 42/199 |
| 3615015 | 12/1987 | Fed. Rep. of Germany | 98/42.21 |

*Primary Examiner*—Harold Joyce

*Attorney, Agent, or Firm*—Barnes, Kisselle, Raisch, choate, Whittemore & Hulbert

[57] ABSTRACT

A roof vent comprising a one piece plastic body including a base wall having transversely spaced rows of integral vanes extending from one surface thereof. The vanes of adjacent rows are positioned such that the vanes define a sinuous path. Preferably, one of each of the rows has the wings extending at an acute angle to the axis of the wall and the other row of each set of rows has the wings extending at an oppositely directed acute axis to the longitudinal axis of the wall toward the wings of the one row. Thus air is vented through sinuous paths outwardly when the vent is positioned with the wings engaging the roof and the base wall spaced from the roof. Water and snow are prevented by the wings from entry beneath the vent into the building.

12 Claims, 5 Drawing Sheets

ROOF VENT

This invention relates to roof vents.

BACKGROUND AND SUMMARY OF THE INVENTION

It has heretofore been known that it is desirable to provide means for ventilating a roof. Typical patents that have been heretofore suggested are, for example, U.S. Pat. Nos. 2,799,214, 3,236,170, 3,949,657, 4,280,399, 4,325,290, and 4,554,862.

Among the objectives of the present invention are to provide an improved roof vent which will effectively vent the interior of a building; which will preclude entry of water and blowing snow and insects by the action of wind from entering the building; which will prevent insects and the like from entering the building; which can be readily adapted to roofs of varying slopes and inclinations; which will prevent ice build-up thereon; which is pleasing in appearance; which is low cost; and which can be readily handled in the field; and which can be utilized for arrangement of roofs which are unsymmetrical.

In accordance with the invention, a roof vent comprising a one piece plastic body including a base wall having transversely spaced rows of integral vanes extending from one surface thereof. The vanes of adjacent rows are positioned such that the vanes define a sinuous path. Preferably, one of each of said rows having the wings extending at an acute angle to the axis of the wall and the other row of each set of rows has the wings extending at an oppositely directed acute axis to the longitudinal axis of the wall toward the wings of the one row. Thus air is vented through sinuous paths outwardly when the vent is positioned with the wings engaging the roof and the base wall spaced from the roof. Water and snow are prevented by the wings from entry beneath the vent into the building.

DESCRIPTION

Figure 1:
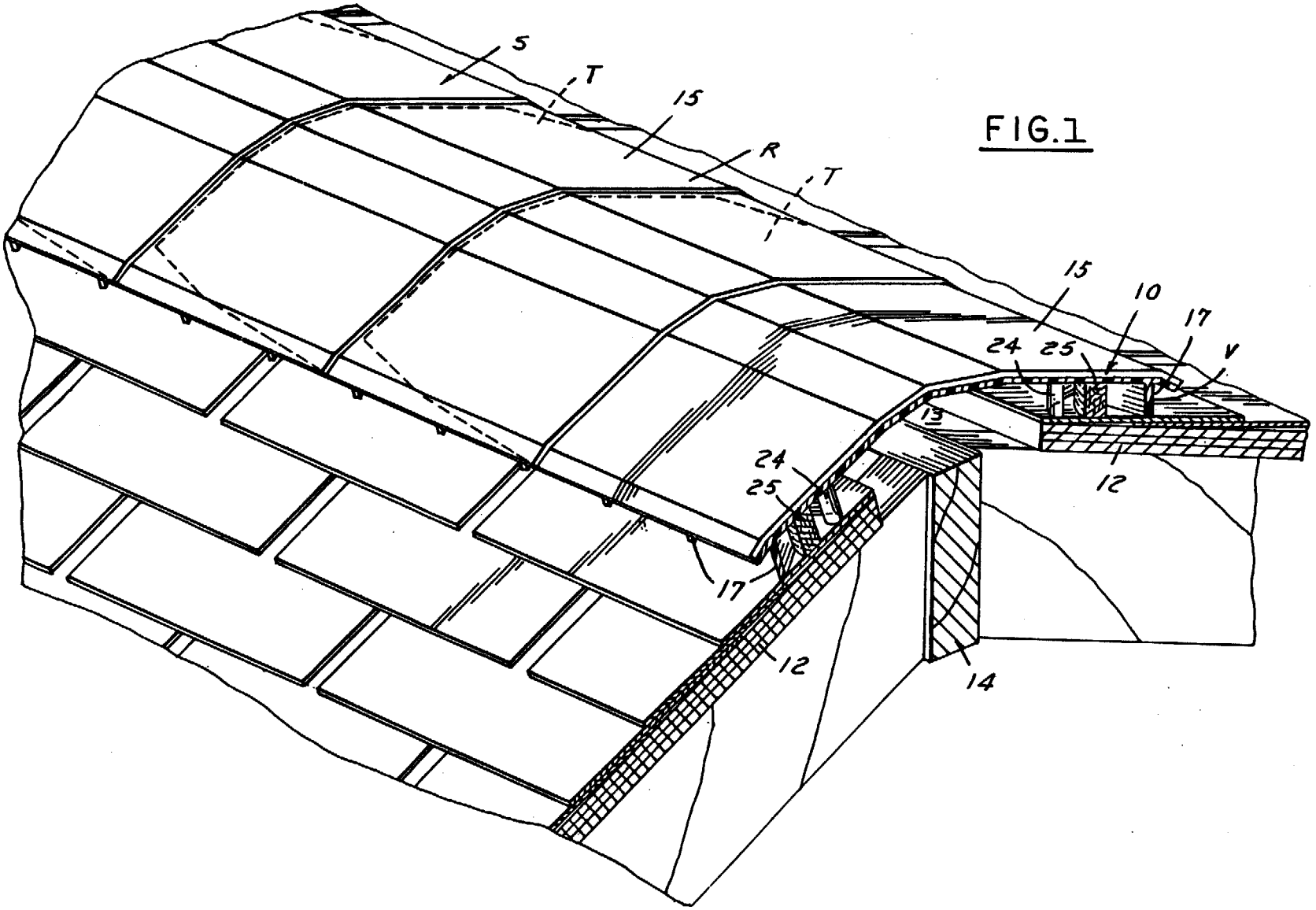
FIG. 1 is fragmentary part sectional view of a building utilizing the roof vent embodying the invention.
Figure 2:
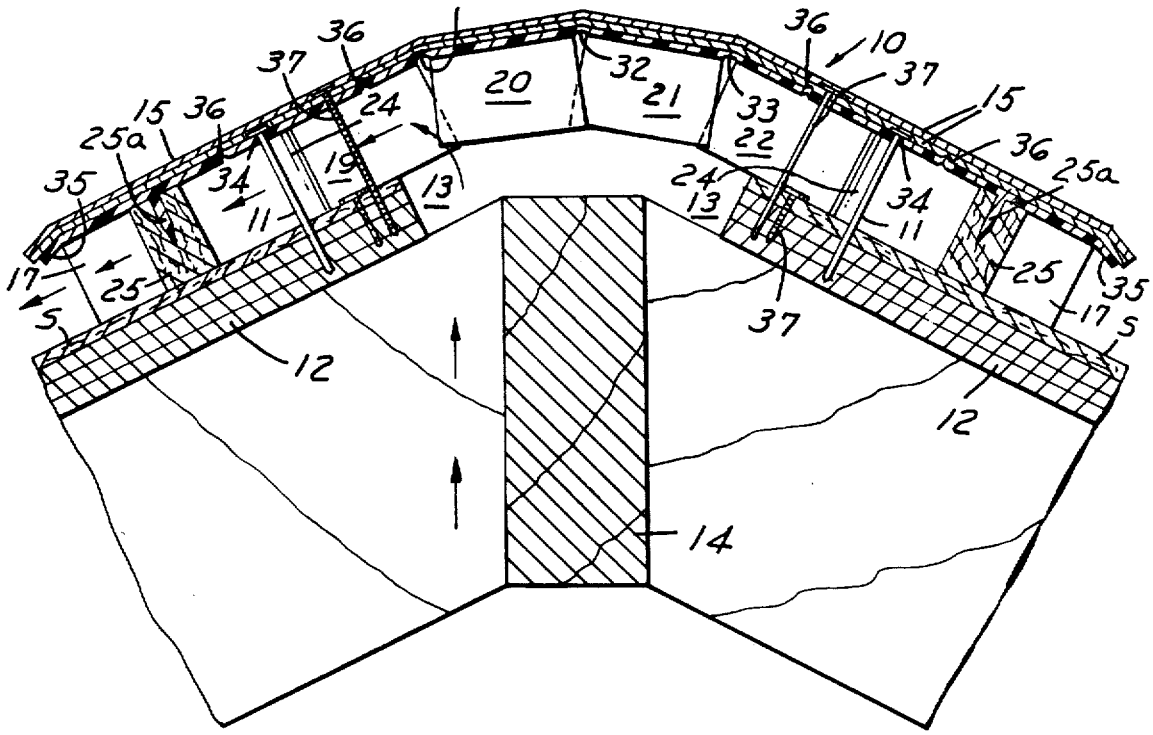
FIG. 2 is a transverse section through a roof of a building utilizing the roof vent embodying the invention.

Referring to FIGS. 1 and 2 the roof vent 10 embodying the invention is adapted to be mounted on the ridge of a roof by nails 11 in order that the interior of the building may be vented. In accordance with well known construction, portions of the roof walls 12 are cut away as at 13 adjacent the ridge board 14 and the vent 10 is positioned over the shingles on the roof walls 12 and over the opening 13. Subsequently, sections of roofing or shingle material 15 are provided over the vent in overlapping relation, if desired over the roof vent.

Figure 5:
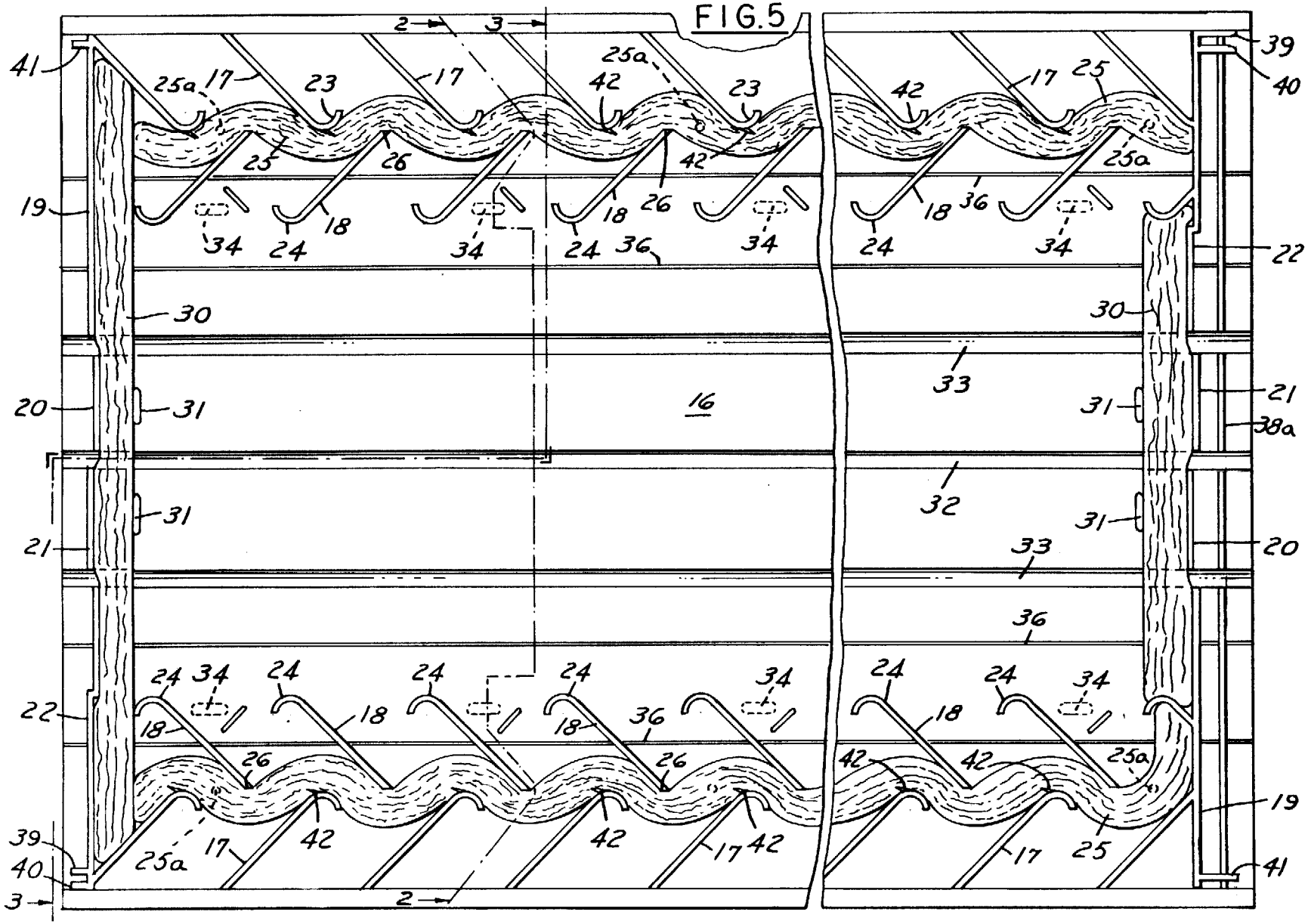
FIG. 5 is a bottom plan of the roof vent embodying the invention before it is bent to conform to the roof.

In accordance with the invention, the roof vent 10 comprises a one piece plastic body which is molded preferably by injection molding and includes a base wall 16 from which a plurality of rows of wings 17, 18 extend in generally perpendicular fashion from the wall 16. In addition the roof vent includes end walls 19, 20, 21, 22 that are molded integrally with the base wall 16 and extend outwardly in relatively longitudinally spaced relation for purposes presently described. Each set of the wings 17, 18 is provided in two rows along the longitudinal edges of the base wall 16 (FIG. 5), the wings 17, 18 being identical except that the row of wings 17 in the outermost row are in longitudinally spaced parallel relation and the wings 18 in the innermost row are in longitudinally spaced relation such that the plane of the wings or rows 17 intersects the plane of the wings 18. In addition, each of the wings 17 is provided with a curved end 23 as are the wings 18 provided with a curved end 24. The curved ends 23, 24 function to entrap water and snow that may be blown inwardly by wind.

Further, a layer 25 of foraminous material such as open cell foam plastic is interposed between the adjacent ends 23 and 26 of the wings 17, 18 and functions to prevent insects from entering the building while permitting air to exit from under the roof. Preferably, the layers 25 are held in position by intergal pins **25*a* that extend from inner surface of the base wall 16**.

Similarly, a layer 30 of nonporous plastic material is provided adjacent each end of the walls 19–22 and is held in position by projections 31 that extend from the surface of the wall to prevent the entry of insects as well as air and moisture through the end walls.

Figure 7:
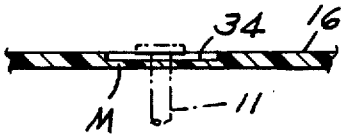
FIG. 7 is a sectional view through a portion of the roof vent as fastened to a roof.

The base wall 16 is formed with portions 32, 33 that extend longitudinally and have a thinner cross section so that the user can bend the wall to the desired angle for conforming the roof vent to the angle of the roof members 12. After such a conformation, the nails 11 can be driven through openings 34 to mount the vent in position on the roof. As shown in FIG. 7, a membrane M of thinner cross section closes the elongated openings 34 such that only a portion of the elongated opening will be pierced by the nail 11 thus minimizing any chance of moisture or rain from entering through the openings that are formed by the piercing. Walls 50 are provided against each opening 34 opposite each wing 18. When a nail 11 is driven, the wing 18 and adjacent wall 50 cooperate to absorb the force of the hammer on the base wall 16 preventing deformation of the back wall 16 as might occur if the portion were not supported. Thus, the pleasing appearance of the roof vent is facilitated.

It can be seen that the periphery of the vent adjacent the shingles is designed such that moisture, snow and rain cannot collect to cause ice build-up.

The edges 35 of the wall are a slight angle to the plan of the wall such that they form an overhang as that shown in FIG. 1. When the base wall 16 is bent along the lines 32, 33, the end walls 20, 21 are caused to overlap one another as viewed in FIG. 1, as shown in the broken lines to close and form a continuous wall.

Figure 6:
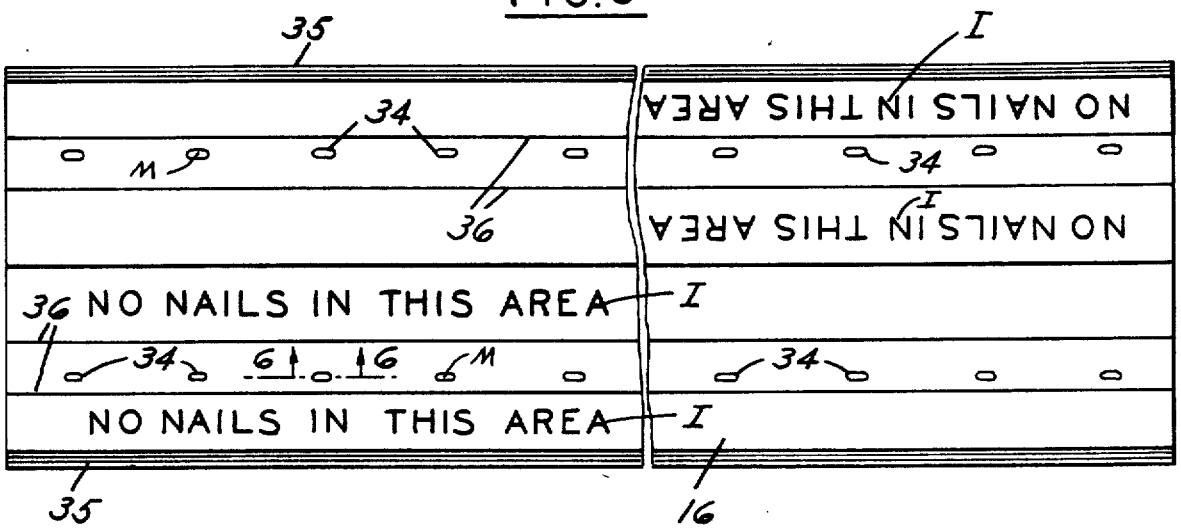
FIG. 6 is fragmentary bottom plan view on a reduce scale of the roof vent shown in FIGS. 3 and 5.

A guide line in the form of an integral ridge 36 is provided along the inner surface of the wall 16 to serve as a visual indicator to the roofer so that the nails 11 for fastening the roofing 15 are provided inwardly of the rows of wings 17, 18. Preferably as shown in FIG. 6, indicia I in the form of lettering is provided in the areas so that a workmen will not nail through these areas.

Figure 4:
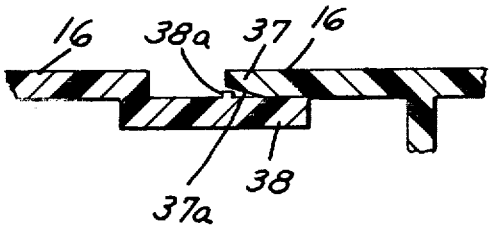
FIG. 4 is a fragmentary view showing the overlapping of adjacent roof vents along a roof.

As adjacent lengths of roof vent are applied to a roof, the ends of the base wall 16 are molded such that opposite ends overlap as at 37, 38 (FIG. 4). In order to provide sufficient space for normal longitudinal expansion and contraction due to temperature changes, aligning ridge 38*a* is provided on base wall 16 and the portion 37 is formed with a bevelled surface 37*a*. The workman utilizes the aligning ridge 38*a* for initial positioning of the adjacent roof vents and the bevel will permit longitudinal movement of the roof vents relative to one another as may occur during expansion and contraction due to temperature variations. In addition, the end walls 19, 22 are provided with spaced longitudinally extending walls portions 39, 40 that cooperate with a portion 41 on the wall 19 to telescope within portions 39, 40 and interfit the ends of one roof vent with respect to the other.

In order to hold the material 25 in position, the wings 17, 18 may also be provided with projections 42 that tend to engage and hold the material in position.

Figure 3:
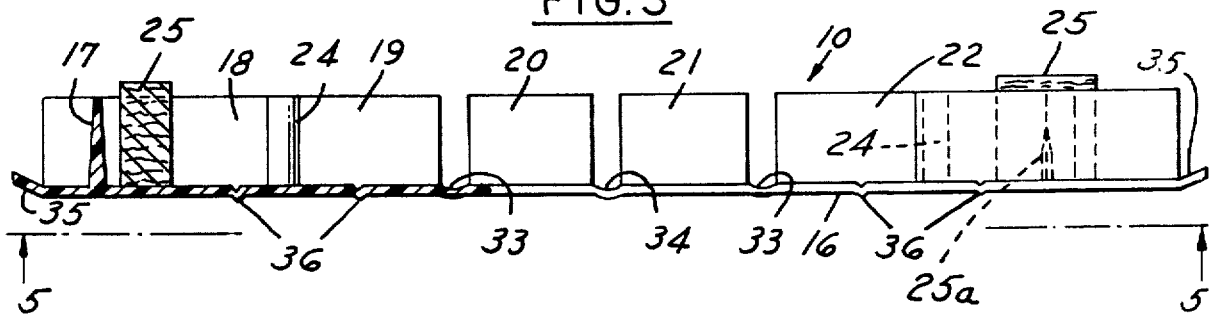
FIG. 3 is a sectional view taken along the line 3—3 in FIG. 5.

As shown in FIG. 3, the height of the layers 25, 30 is greater than the height of the wings 17, 18 and end walls 19–22 such that when the vent is nailed into position, the layers 25, 30 become compressed to seal against the shingles and fill any underlying slots in the shingles.

Figure 8:
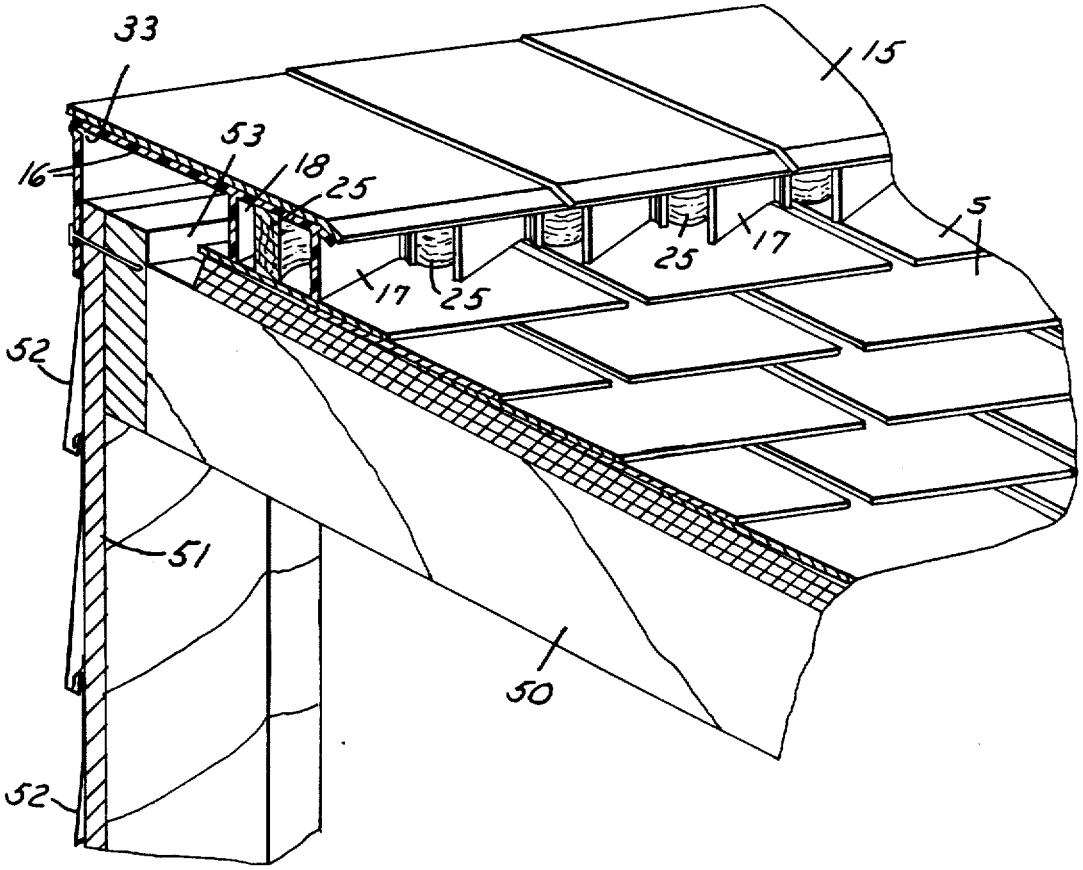
FIG. 8 is fragmentary sectional perspective view showing the adaptation of the roof vent to a different roof.

Although the roof vent embodying the invention is particularly intended for use in connection with roofs that have incline roof walls 12 as shown in FIGS. 1 and 2, it can readily adapted to other roof arrangements by severing a portion of the roof vent along a line 33 by a hand knife. Thus as shown in FIG. 8 such a partial roof vent can be adapted to a roof having an inclined wall 50 that extends from a vertical wall 51 that has siding 52 thereon. In such an arrangement, the roof vent from which part of the base wall and two rows of the wings have been severed is positioned with the remaining rows of the roof vent and base wall overlying the opening 53 which is to be vented with base wall 16 folded about the remaining bend line 33 to extend in overlapping relation to the uppermost siding 52. The roof vent is nailed in the same fashion over the shingles S of the wall 50, and if desired shingle sections 15 can be provided over the roof vent.

Figure 9:
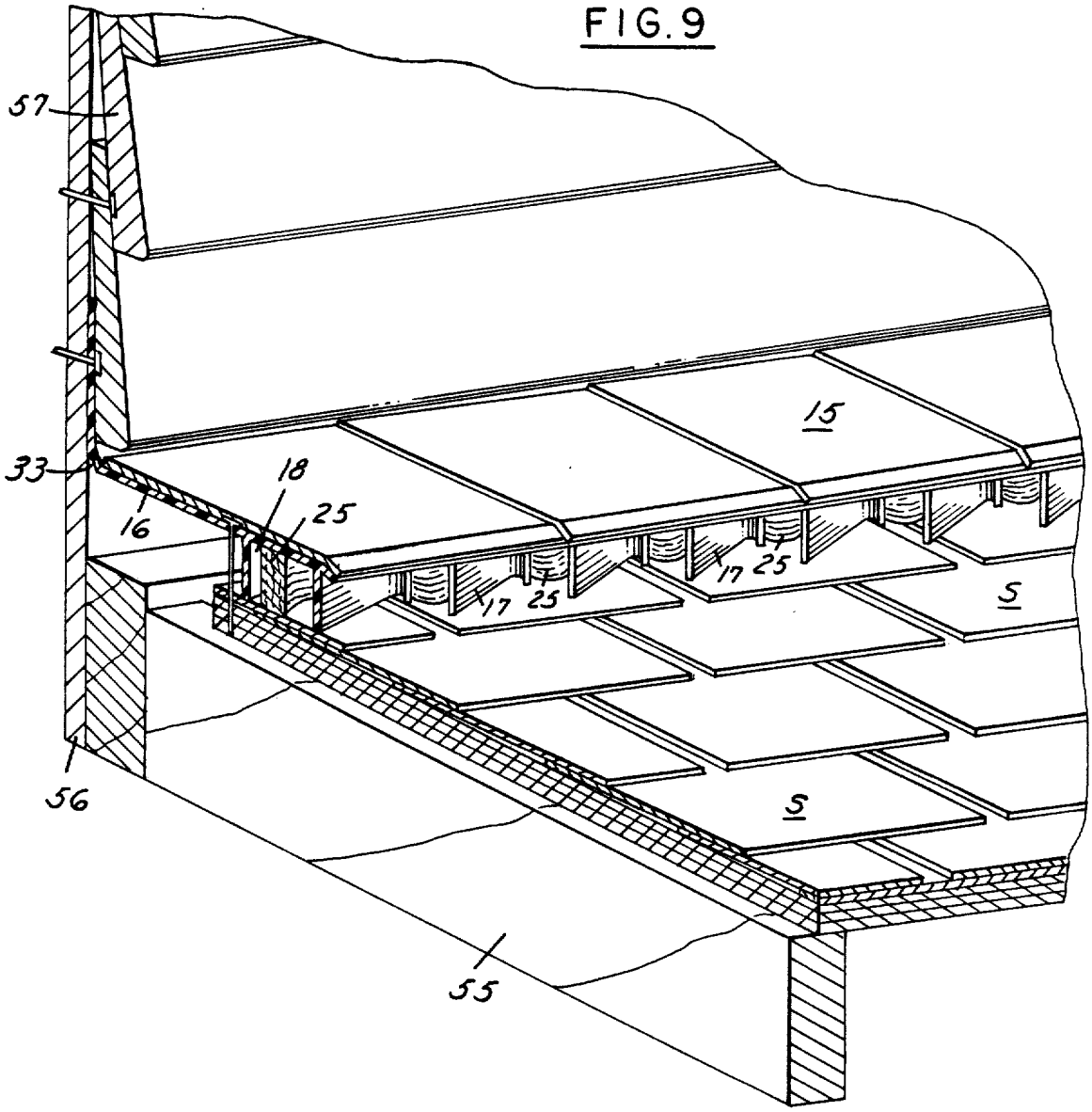
FIG. 9 is fragmentary sectional perspective view showing the adaptation of the roof vent to another roof.

The partial roof vent can also be utilized in an arrangement such as shown in FIG. 9 wherein the roof 55 is inclined and intersects a wall 56 that extends vertically above the roof and has siding 57 thereon. As in the form shown in FIG. 8 the remaining rows of wings contact the shingles S and wall 16 is bent along the line 33 to extend along the vertical wall 56 of the building.

It can thus be seen that there has been provided a roof vent which will effectively vent the interior of a building; which will preclude entry of water and blowing snow and insects, by the action of wind from entering the building; which will prevent ice build-up thereon; which can be readily adapted to roofs of varying slopes and inclinations; which is pleasing in appearance; which is low cost; and which can be readily handled in the field; and which can be utilized for arrangement of roofs which are unsymmetrical.

We claim:

1. A roof vent comprising a one-piece plastic body including a base wall having transversely spaced sets of rows of integral vanes extending from one surface thereof, each vane having a free end adapted to engage the roof when the vent is in position on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angel to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer.

2. The roof vent set forth in claim 1 wherein the vanes are generally planar.

3. The roof vent set forth in claim 1 including end walls integral with said base wall, said end walls overlapping one another when the roof vent is bent and applied to a roof.

4. The roof vent set forth in claim 3 including a layer of nonporous material adjacent said end walls.

5. The roof vent set forth in claim 4 wherein one end of said base wall is adapted to overlap the other end of the base wall of an adjacent roof vent.

6. The roof vent set forth in claim 5 wherein said one edge has a tapered surface, said other end having a guide ridge for indicating initial positioning of adjacent roof vent.

7. The roof vent set forth in claim 1 wherein said roof vent includes integral walls extending from said base wall adjacent each nail opening and cooperating with a vane to absorb the force of a hammer utilized to drive a nail through said opening.

8. The roof vent set forth in claim 1 including integral end walls and interengaging means at each end of said vent, said interengaging means at one end being adapted to interengage the interengaging means at the other end of an adjacent roof vent.

9. The roof vent set forth in claim 8 wherein said interengaging means at one end comprises spaced longitudinally extending integral wall portions and said interengaging means at the other end comprises an integral longitudinally extending wall portion adapted to interfit between the wall portions of an adjacent roof vent.

10. The roof vent set forth in claim 1 wherein said base wall has an integral aligning ridge at one end portion and a bevelled portion at the other end such that while the end portion of one roof vent is overlapped so that said one end portion has its aligning ridge aligned with the other end portion sufficient space is provided for normal expansion and contraction.

11. A roof vent comprising a one-piece plastic body including a base wall having at least one set of transversely spaced sets of rows of integral vanes extending from one surface thereof, each vane having a free end adapted to engage the roof when the vent is positioned on a roof, the vanes in each row of vanes of each set of vanes being longitudinally spaced from one another, parallel to one another, and extending at an acute angle to the axis of the wall and the vanes of the other row of each set of rows being longitudinally spaced from one another, parallel to one another and extending at an oppositely directed acute angle to the longitudinal axis of the wall, each outermost row of vanes being arranged such that the general plane of each vane intersects the general plane of an adjacent vane of an inner row, each vane having an outer free edge and an inner free edge, each vane having the inner free end thereof generally curved such that the free edge of said free end extends outwardly, a layer of porous material positioned between adjacent rows of vanes, said layer having a height greater than the height of the vanes such that when the vent is positioned with the vanes engaging the roof and the base wall spaced from the roof, air is vented through sinuous paths defined by successive rows of vanes outwardly and water and snow are prevented from entry beneath the vent into the building by the vanes and the layer.

12. The roof vent set forth in claim 11 wherein the vanes are generally planar.

* * * * *